US007322171B2

(12) United States Patent
Bonnain et al.

(10) Patent No.: US 7,322,171 B2
(45) Date of Patent: Jan. 29, 2008

(54) METHOD AND APPARATUS FOR CONSTRUCTING CARTON

(75) Inventors: Jean-Christophe Bonnain, Chateauroux (FR); John W. Cargile, Jr., Decatur, GA (US)

(73) Assignee: MeadWestvaco Packaging Systems, LCC, Glen Allen, VA (US)

( * ) Notice: Subject to any disclaimer, the term of this patent is extended or adjusted under 35 U.S.C. 154(b) by 53 days.

(21) Appl. No.: 11/268,354

(22) Filed: Nov. 7, 2005

(65) Prior Publication Data

US 2006/0117716 A1 Jun. 8, 2006

Related U.S. Application Data

(60) Provisional application No. 60/625,431, filed on Nov. 5, 2004.

(51) Int. Cl.
*B65B 35/56* (2006.01)
*B65B 11/12* (2006.01)

(52) U.S. Cl. ..... 53/446; 53/544; 53/466; 53/233; 53/209; 53/491; 53/377.2; 53/462

(58) Field of Classification Search ..... 53/456, 53/462, 466, 491, 48.7, 48.8, 564, 558, 209, 53/232, 233, 377.2, 377.6, 387.2, 458, 467, 53/49, 446, 544

See application file for complete search history.

(56) References Cited

U.S. PATENT DOCUMENTS 2,270,820 A 1/1942 Kaliska
2,312,651 A 3/1943 Koolnis
2,701,938 A * 2/1955 Murray ..... 53/398
3,095,137 A 6/1963 Reynolds
3,184,136 A 5/1965 Forbes, Jr.
3,224,159 A * 12/1965 Pitt et al. ..... 53/397
3,226,007 A 12/1965 Thies et al.
3,363,824 A 1/1968 Murata
3,377,774 A * 4/1968 Nigrelli et al. ..... 53/250
3,411,264 A * 11/1968 Farquhar ..... 53/456
3,469,766 A 9/1969 Nelson
3,638,391 A * 2/1972 Fluck ..... 53/475
3,669,251 A 6/1972 Phillips, Jr.

(Continued)

FOREIGN PATENT DOCUMENTS

EP 0 738 664 A1 4/1996

(Continued)

OTHER PUBLICATIONS

English language translation of JP 59-163102, PTO 07-3155, Mar. 2007.*

*Primary Examiner*—Stephen F. Gerrity
(74) *Attorney, Agent, or Firm*—Thomas A. Boshinski

(57) ABSTRACT

A method and apparatus for packaging articles such as pouches which do not have rigid structures. The method includes the steps of placing first and second sets of the articles onto spaced apart loading panels of a carton blank so that the article sets are spaced apart with an unloaded further panel of the blank disposed between the article sets, raising the spaced loading panels together with the respective sets of articles to transfer the sets of articles to the unloaded further panel so that the unloaded further panel becomes the loaded base of the carton and the loading panels become opposed side panels of the carton.

18 Claims, 7 Drawing Sheets

U.S. PATENT DOCUMENTS

| | | | | |
|---|---|---|---|---|
| 3,884,013 | A * | 5/1975 | Solomon | 53/467 |
| 4,726,471 | A | 2/1988 | Whately et al. | |
| 5,148,654 | A | 9/1992 | Kisters | |
| 5,722,584 | A | 3/1998 | Fujiwara | |
| 5,749,513 | A | 5/1998 | Strauser | |
| 5,881,884 | A | 3/1999 | Podosek | |
| 5,927,498 | A | 7/1999 | Saam | |
| 2003/0213722 | A1 | 11/2003 | Kinigakis | |
| 2004/0007614 | A1 | 1/2004 | Saulas | |

FOREIGN PATENT DOCUMENTS

| | | | |
|---|---|---|---|
| EP | 1 262 417 | A3 | 12/2002 |
| FR | 1 501 894 | | 9/1966 |
| GB | 1 206 773 | | 9/1970 |
| JP | 59-163102 | | 9/1984 |
| JP | 11-105855 | | 4/1999 |
| WO | WO 97/06061 | A1 | 2/1997 |
| WO | WO 2005/108218 | | 11/2005 |

* cited by examiner

METHOD AND APPARATUS FOR CONSTRUCTING CARTON

This application claims the benefit of Provisional Application No. 60/625,431 filed Nov. 5, 2004.

BACKGROUND OF THE INVENTION

The invention relates to a method and apparatus for constructing a carton for containing multiple articles and more particularly when the articles the carton contains are of a non-rigid structure such as pouches which may be filled with beverages or other foodstuffs and/or liquids.

Often it is desirable for a consumer to purchase a number of articles such as pouches filled with a beverage. Cartons containing a group of pouches are therefore required. Such pouches are flexible any may be delicate and can be difficult to securely and tightly package into a carton.

Current commercial packages for these types of article are constructed from corrugated board, which is used to provide sufficient strength for palletisation of pluralities of packages but has the disadvantage that it produces a poor quality finished product especially with regard to the printed surfaces. Another disadvantage of these packages is that they require the carton blank to be pre-glued.

It is therefore desirable to provide a carton with a high aesthetic quality which has sufficient strength for palletisation. It is also desirable to reduce the handling of the pouches to minimize the possibility of damage to them.

The present invention seeks to overcome the limitations of the prior art, and offer improved print quality and allows the process of carton construction and loading to be carried out in one manufacturing machine.

SUMMARY OF THE INVENTION

One aspect of the present invention provides a method of forming a carton containing a group of articles, which method comprises placing first and second sets of the articles onto spaced apart loading panels of a carton blank so that the article sets are spaced apart with an unloaded further panel of the blank disposed between the article sets, raising the spaced loading panels together with the respective sets of articles to transfer the sets of articles to the unloaded further panel so that the unloaded further panel becomes a loaded base of the carton and the loading panels become opposed side panels of the carton.

Preferably wherein the carton blank in substantially flat form is transferred from a supply to a forming jig so that spaced apart loading panels of the blank are placed on spaced outer sections of the jig with the further panel of the blank disposed there between on an inner section of the jig and so that opposed end closure panels of the blank automatically are folded out of the plane of respective loading panels and loading a set of articles onto each of said loading panels.

Additionally wherein reinforcing panels, hinged to the end closure panels are folded relative to the end closure panels so that a reinforcing panel is caused to overlie the endmost articles in each set such that each endmost article is substantially surrounded by a loading panel, an end closure panel and a reinforcing panel.

Optionally wherein a separator device is positioned between each article set substantially to prevent movement of the article sets, on their respective loading panels towards one another.

Preferably wherein the spaced outer sections of the jig are raised so that the loading panels with their respective articles sets are raised, and retracting the separator device as the article sets are brought together and the loading panels are brought into an upright attitude whereby the article sets are brought together with the ends of the articles in each set brought to rest on said further panel of the blank, destined to become a base panel of the carton, with the loading panels providing opposed side panels of the carton.

Optionally wherein juxtaposed reinforcing panels are brought into face to face relationship to provide a multiply partition between the endmost articles of each article set.

Preferably wherein the carton panels are secured to complete the carton around the consolidated article sets and the spaced outer sections of the jig are returned to their original positions to receive respective loading panels of the next succeeding carton blank.

Additionally wherein successive article sets are formed on article conveying means which is synchronized with conveying means for inclusive blank and jig units and the requisite article sets and drop-loaded onto pre-determined ones of the loading panels of each blank.

Another aspect of the present invention provides an apparatus for forming a carton containing a group of articles which apparatus comprises a supporting means on which a carton blank, together with first and second sets of articles is received, the articles being disposed on spaced apart loading panels of the blank so that the articles sets are spaced apart with an unloaded further panel of the blank disposed between the article sets, and means for manipulating the support means to raise the loading panels together with the respective sets of articles to transfer the sets of articles to the unloaded further panel so that the unloaded further panel receives both sets of articles and so that the unloaded further panel becomes a loaded base of the carton and the loading panels become opposed side panels of the carton.

According to a feature of this aspect of the invention, the supporting means may comprise a forming jig and wherein carton blank transfer means may be provided for transferring successive carton blanks from a supply and placing each blank on said jig and means for grouping and depositing discrete groups of articles onto said blank while it is disposed on said jig. Preferably, the means for raising the loading panels may comprises hinged sections of said jig. Preferably, the jig comprises a means, for example a follower device, which follows a predetermined path in a track or runner which facilitates the raising of the hinged sections and thereafter lowering of the hinged sections for reloading.

According to another feature of this aspect of the invention, means may be provided for limiting movement of the article sets towards one another relative to the loading panel during carton assembly.

According to yet another feature of this aspect of the invention, the means for limiting movement of the articles relative to the loading panel may comprise a device placed into the unfolded carton between the two sets of articles and which further maintains alignment of reinforcing panel members of the carton blank while the blank is being manipulated to form the carton.

BRIEF DESCRIPTION OF THE DRAWINGS

An exemplary embodiment of the invention will now be described, by way of example only, with reference to the accompanying drawings in which.

DETAILED DESCRIPTION OF THE PREFERRED EMBODIMENTS

Figure 1:
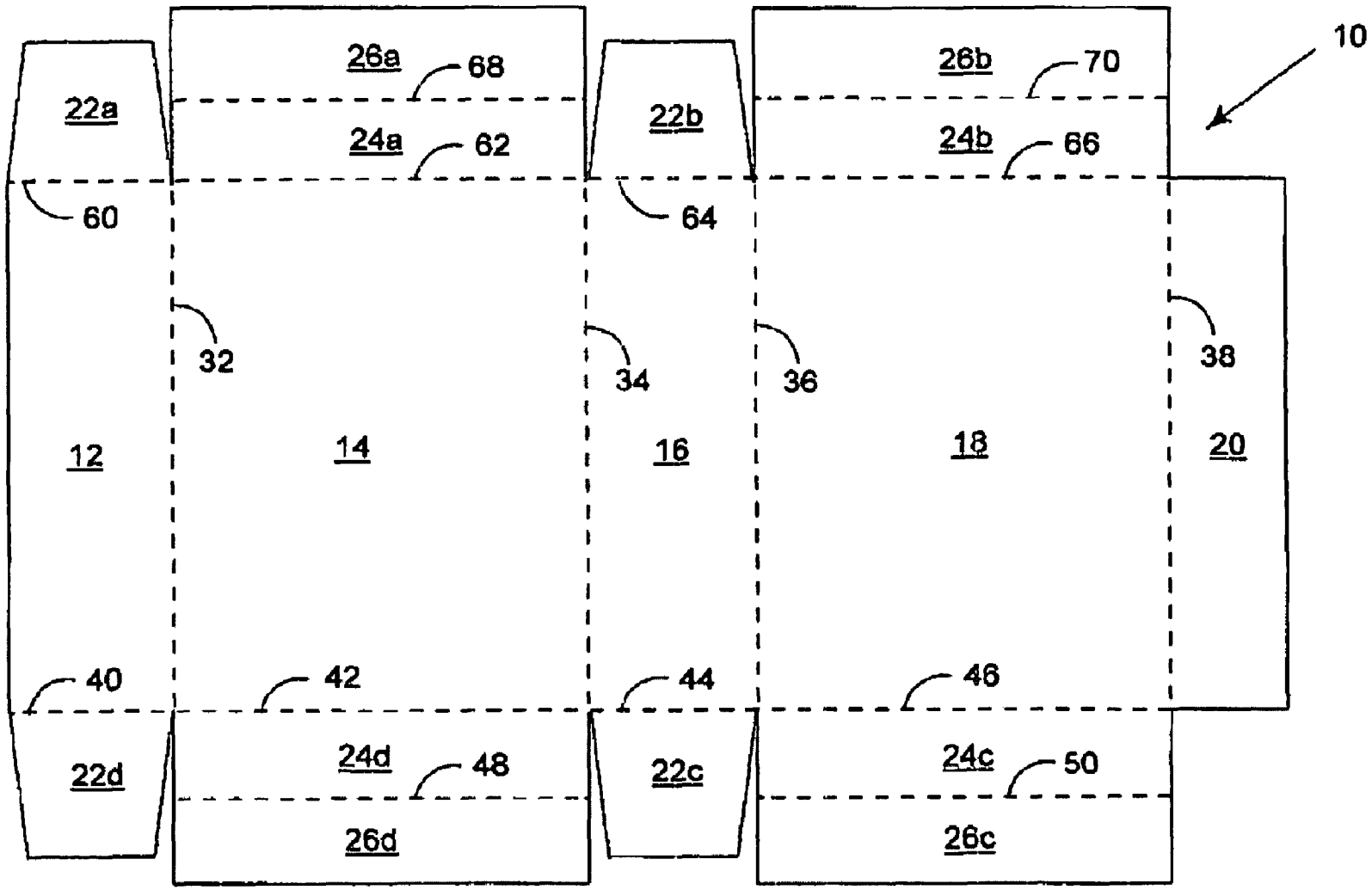
FIG. 1 is a plan view of a blank for forming a carton which is constructed by a packaging machine of the present invention.
Figure 2:
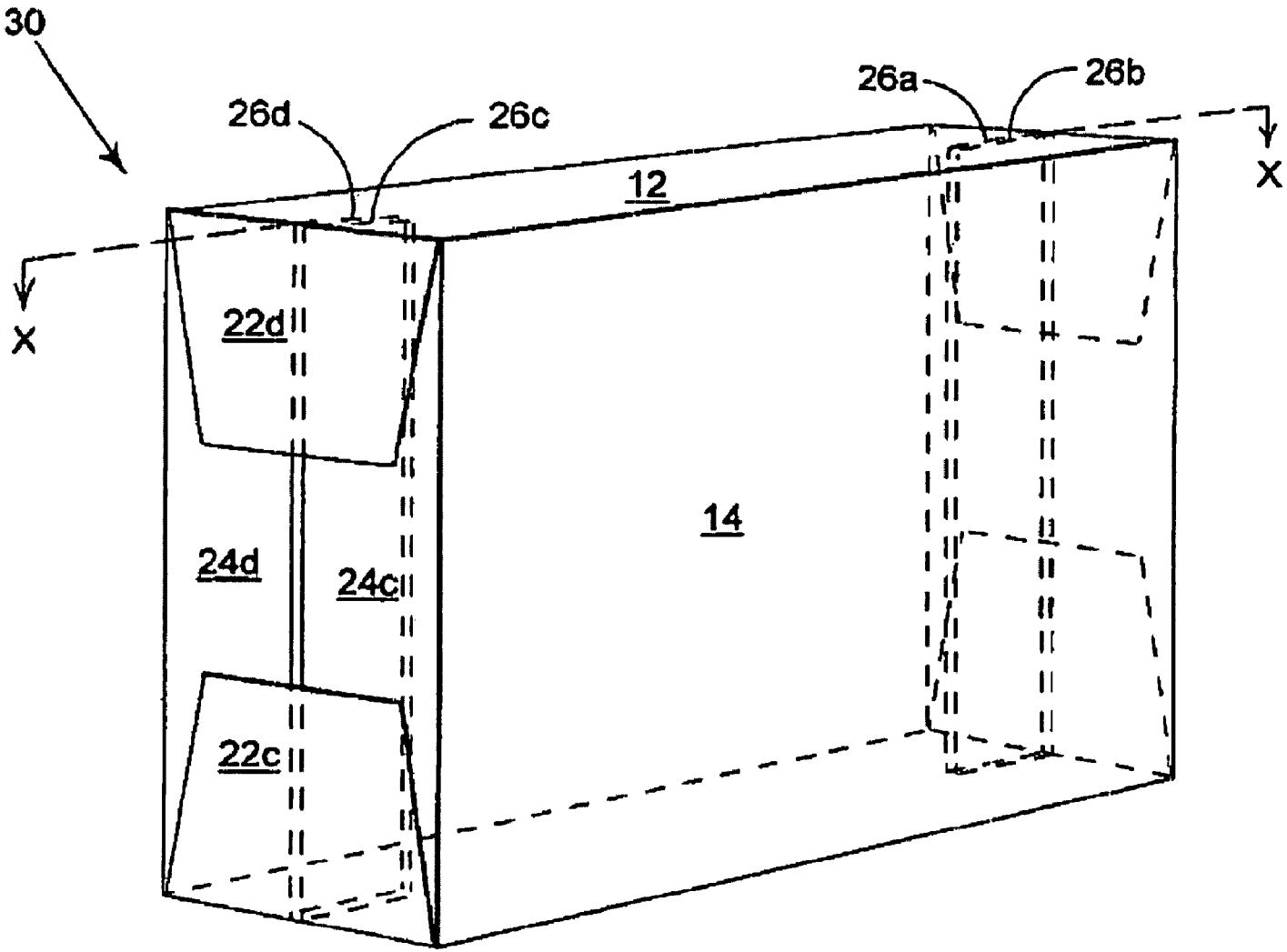
FIG. 2 is a perspective view of an empty carton formed from the blank of FIG. 1.

A preferred embodiment of the present invention provides a packaging machine which can construct and fill a carton with pouches or similar such articles. FIG. 1 shows a blank 10 for forming a carton 30, which is shown in FIG. 2, which may be constructed by the packaging machine. It is envisaged that the packaging machine may be suitable for filling and constructing other types of carton and is not limited to the carton herein described.

The blank 10 is a unitary blank formed from paperboard but may be formed from other such suitable foldable sheet material. The blank 10 comprises a series of main panels including a top panel 12, first side wall 14, bottom panel 16, second side wall 18 and securing panel 20, hinged one to the next in series along fold lines 32, 34, 36 and 38 respectively. Collectively the first and second side walls 14, 18 and bottom panel 16, form a loading panel. Spaced apart loading panels, the first and second side walls 14, 18, are separated by a further panel, the bottom panel 16.

When the package is constructed, these spaced apart loading panels are loaded with pouches, or other similar articles. The pouches are grouped into two sets of five pouches each in the preferred embodiment. These loading panels are provided by the first and second side walls 14 and 18, respectively.

The blank 10 further comprises a series of end closure panels 24*a*, 24*b*, 24*c*, 24*d*, each hinged to an opposed end of each of the first and second side walls 14, 18, along fold lines 62, 66, 46 and 42 respectively. Additionally reinforcing members 26*a*, 26*b*, 26*c* and 26*d* are provided and are hinged to each of the end closure panels 24*a*, 24*b*, 24*c* and 24*d* along fold lines 68, 70, 50 and 48 respectively. Bottom end closure flaps 22*b*, 22*c* and top end closure flaps 22*a*, 22*d* are also provided and are hinged to the opposed ends of the bottom panel 16 and first top panel 12 along fold lines 64, 44, 60 and 40 respectively.

Turning to the construction of the carton 30, shown in FIG. 2, from the blank 10, the fold lines 32, 34, 36, 38, 40, 42, 44, 46, 48, 50, 60, 62, 64, 66, 68, 70 may be pre-folded or pre-broken to assist the formation of the blank 10 into the carton 30 by the packaging machine. The end closure panels 24*a*, 24*b*, 24*c*, 24*d* are folded outward of the plane of the blank 10 along with reinforcing members 26*a*, 26*b*, 26*c*, 26*d*, so that the end closure panels 24*a*, 24*b*, 24*c*, 24*d* are positioned substantially at a 90° angle to the first and second side walls 14, 18. The reinforcing members 26*a*, 26*b*, 26*c*, 26*d* are further folded about fold lines 68, 70, 50, 48 such that the pouches at each end of the group are substantially surrounded on three sides by either the first or second side walls 14, 18 and the respective end closure panel 24*a*, 24*b*, 24*c*, 24*d* and reinforcing member 26*a*, 26*b*, 26*c*, 26*d*.

Each of the side wall panels 14, 18 are folded out of the plane of the bottom panel 16 toward each other such that they are substantially parallel to each other and at approximately 90° to the bottom panel 16. In this way, the reinforcing members of each pair 26*a*/26*b* and 26*d*/26*c* are brought into flat face contacting relation with each other.

To complete the construction of the carton; the securing panel 20 is folded inward of the carton 30, the first top panel 12 is folded to overlie the securing panel 20 and secured to it. The bottom and top end closure flaps 22*b*, 22*c*, 22*a*, 22*d* are folded towards the end closure panels 24*a*, 24*b*, 24*c*, 24*d* and secured, to lower and upper portions of the end closure panels 24*a*/24*b*, 24*c*/24*d* respectively. In this way a completely enclosed carton is formed.

It will be seen (FIG. 2) that the completed carton comprises two similar compartmental portions since it is symmetrical about the vertical plane "x-x" and in effect, therefore, is the combination of two tray-like elements which are hinged together about fold line 34 and 36.

One tray-like element comprises side wall panel 14 together with reinforcing members provided by panels 24*a*, 26*a* and 24*d*, 26*d* and the other tray-like member comprises side wall panel 18 together with 24*b*, 26*b* and 24*c*, 26*c*.

When these tray-like portions are put into an upright disposition, from their initial loading position, so that the two sets of pouches are brought into juxtaposition panels 26*a* and 26*b* and panels 26*c* and 26*d* respectively, are in face to face relationship thereby providing multiply partitions 26*a*/26*b* and 26*c*/26*d* internally of the carton intermediate the two sets of pouches.

Figure 3:
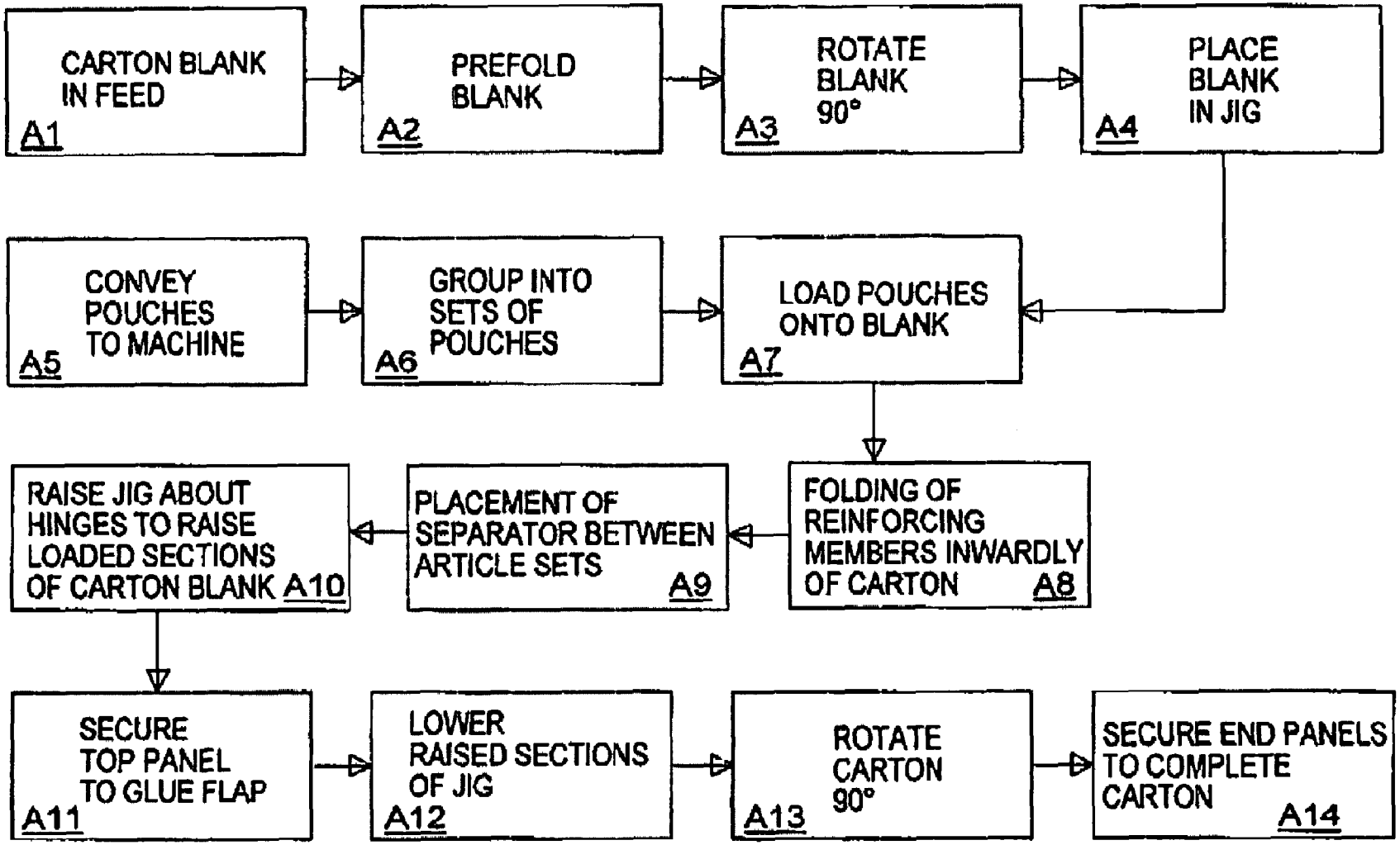
FIG. 3 is a flow chart outlining the preferred method employed by the packaging machine to construct the carton of FIG. 2.

Referring now to FIG. 3 of the drawings, there is shown a flow chart of a method employed by the packaging machine for processing blanks 10 of the type outlined above. An upstream end of the machine includes a first hopper 11 (see FIG. 6), or other suitable storage means in which a multiplicity of blanks 10, in flat condition, are held ready for processing. The blanks 10 are sequentially removed from the first hopper 11 by suitable feeder means, for example, a rotary vacuum feeder 13. As is known in the art of the rotary vacuum feeder comprises at least one suction cup 13*a* connected to a drive shaft 13*b* by a drive rod 13*c*. Drive means, for example a servo motor (not shown), rotates the drive shaft, and a cam track and cam rod (not shown) internally of the rotary vacuum feeder may be provided to define a uniform path for the suction cups as the drive shaft is rotated.

The first hopper 11 may be a 'gravity feed' type, whereby the blanks 10 are held on the first hopper at an incline to provide a positive feed. Thus, a blank 10 in flat condition is removed from the first hopper and is rotated by the vacuum feeder 13 to an in-feed conveyor 15 at the in-feed end of the machine. Thus, the blank 10 is placed onto suitable conveying means, step A1.

The blank 10 may then undergo a series of pre-folding stages, step A2, to pre-break the fold lines of the blank 10. The pre-breaking procedure may be achieved by passing the blank 10 past a series of wheels or guide tracks as is known in the art. When the articles, in this case pouches, to be packaged do not have a rigid structure they provide little or no reaction to forces applied to them. It is therefore advantageous to pre-fold or pre-break the fold lines of the blank 10. This stage may be unnecessary if an alternative material were to be used to construct the blank 10 or if the carton 30 were to be loaded with a more rigid type of article. The pre-breaking stage is illustrated by stage B1 of FIG. 4. The pre-breaking is achieved in the preferred embodiment with the blank 10 moving, in the forward direction indicated by an arrow, through the packaging machine in the orientation shown in stage B1.

The blank 10 is then rotated, Step A3, about a vertical axis through approximately 90°. This stage may be unnecessary in an alternative embodiment if the pre-breaking sequence does not require the blank 10 to be in a different orientation to that required for the construction procedure. The rotation is achieved by picking up the blank using a rotatable suction device 17 (FIG. 6) known per se in the art, and rotating the blank through the desired angle. Referring to stage B1 of FIG. 4 it can be seen that the blank is rotated in a clockwise direction as shown by the arrow A, but it should be obvious the present invention is not limited to such.

The blank 10 is then placed by vertical movement of the rotatable suction device 17, step A4, into a forming jig 110 to be herein described with reference to FIGS. 5 and 6. This step may be carried out prior to the rotation stage of step A3 in which case the blank 10 and the jig 110 may be rotated together. The blank 10 is placed such that the panels 14, 16, 18 are placed in registry with sections 132*a*, 140 and 132*b* respectively. Spaced apart loading panels 14, 18 of the blank 10 are placed on spaced outer sections 132*a* and 132*b* and the bottom panel 16 is placed on inner section 140. The bottom end closure flaps 22*b*, 22*c* protrude through the respective gaps between the end walls 124*a*/124*b* and 124*c*/124*d*. The end closure panels 24*a*, 24*b*, 24*c*, 24*d* are folded upward out of the plane of the panels 14, 16, 18 when the blank 10 is placed in the jig 110 since the end walls 124*a*, 124*b*, 124*c*, 124*d* engage the end closure panels and facilitate folding about fold lines 42, 46, 62, 66 as shown in stage B2 of FIG. 4. In alternative embodiments it may be necessary to first fold end closure panels 24*a*, 24*b*, 24*c*, 24*d* upwardly out of the plane of the loading panel of the blank, about fold lines 42, 46, 62, 66. However in the preferred embodiment folding of the end closure panels 24*a*, 24*b*, 24*c*, 24*d* is achieved automatically when the blank 10 engages the end walls 124*a*, 124*b*, 124*c*, 124*d* upon placement into the forming jig 110.

The pouches are conveyed, step A5, to the packaging machine, whilst, before or after, the steps A1-A4 relating to the blank's 10 preparation; in this case comprising; loading A1, pre-folding A2, rotating A3 and placement A4 of the blank 10 in the forming jig 110. In the preferred embodiment the pouches are conveyed to the packaging machine and grouped, step A6, into sets of articles whilst the blank 10 is partially folded, as described. The pouches require careful handling to minimize the risk of damage.

The pouches are fed from outfeed conveyors 19, 21 of a pouch filing device (not shown) into individual caddies 23, 25 where they are grouped together on the out-feed conveyor. The contents of the caddies are then emptied into trays 27, 29 respectively capable of accommodating multiple pouches, as disclosed in PATENT NUMBER U.S. Pat. No. 5,046,598 which is hereby incorporated by reference. Each tray conveys a group of pouches to the blank 10 disposed on a jig 110 as further described below.

The pouches are loaded, step A7, onto the blank 10 in sets or groups of pouches. This is achieved by positioning each tray above the blank and opening trap doors 31, 33 in respective ones of the trays 27, 29 the trays allowing the pouches to fall onto the blank. In the preferred embodiment the articles are loaded in two sets of five each, a tray being used to convey each set. However, it is envisaged that a different grouping could be used. The sets of pouches are loaded onto the loading panels 14, 18 of the blank, one set being placed upon panel 14 and the other set upon panel 18 and are spaced apart by a further panel 16 of the blank 10. In the preferred embodiment, the pouches are oriented such that the bottoms of the pouches all face the same direction when loaded on the blank 10, as shown in stage B3 of FIG. 4. The pouches are loaded in this way because they are tapered; this orientation of the pouches allows the narrow end of one set of pouches to be juxtaposed with the wide end of the other set of pouches. The pouches in each of the sets are also placed in a side by side overlapping relationship again to minimize the unused space in the assembled package. Thus, the volume occupied by the pouches is minimized and allows the package size to be reduced. Alternative embodiments may utilize alternative orientations and configurations of the pouches within the carton 30 without departing from the scope of the invention.

The next stage in the package assembly is folding, step A8, of the reinforcing members 26*a*, 26*b*, 26*c*, 26*d*. The reinforcing members 26*a*, 26*b*, 26*c*, 26*d* are folded inwardly about fold lines 48, 50, 68, 70 of the carton 30 around at least a portion of the sets of pouches such that the pouches at each end of the group are substantially surrounded on three sides by either the first or second side walls 14, 18 and the respective end closure panel 24*a*, 24*b*, 24*c*, 24*d* and reinforcing member 26*a*, 26*b*, 26*c*, 26*d*. This is best shown in stage B4 of FIG. 4.

The folding of these reinforcing members may be achieved by use of wheels or fixed guides as known in the art. However, it is envisaged that other means could be used without departing from the scope of the present invention. The reinforcing members 26*a*, 26*b*, 26*c*, 26*d* enhance the strength of the constructed package to allow palletisation or otherwise stacking of a plurality of assembled packages. In alternative embodiments where rigid articles may used in the package these reinforcing members 26*a*, 26*b*, 26*c*, 26*d* may not be required as the articles themselves may contribute sufficient strength to the package to allow palletisation of the packages.

Figure 5:
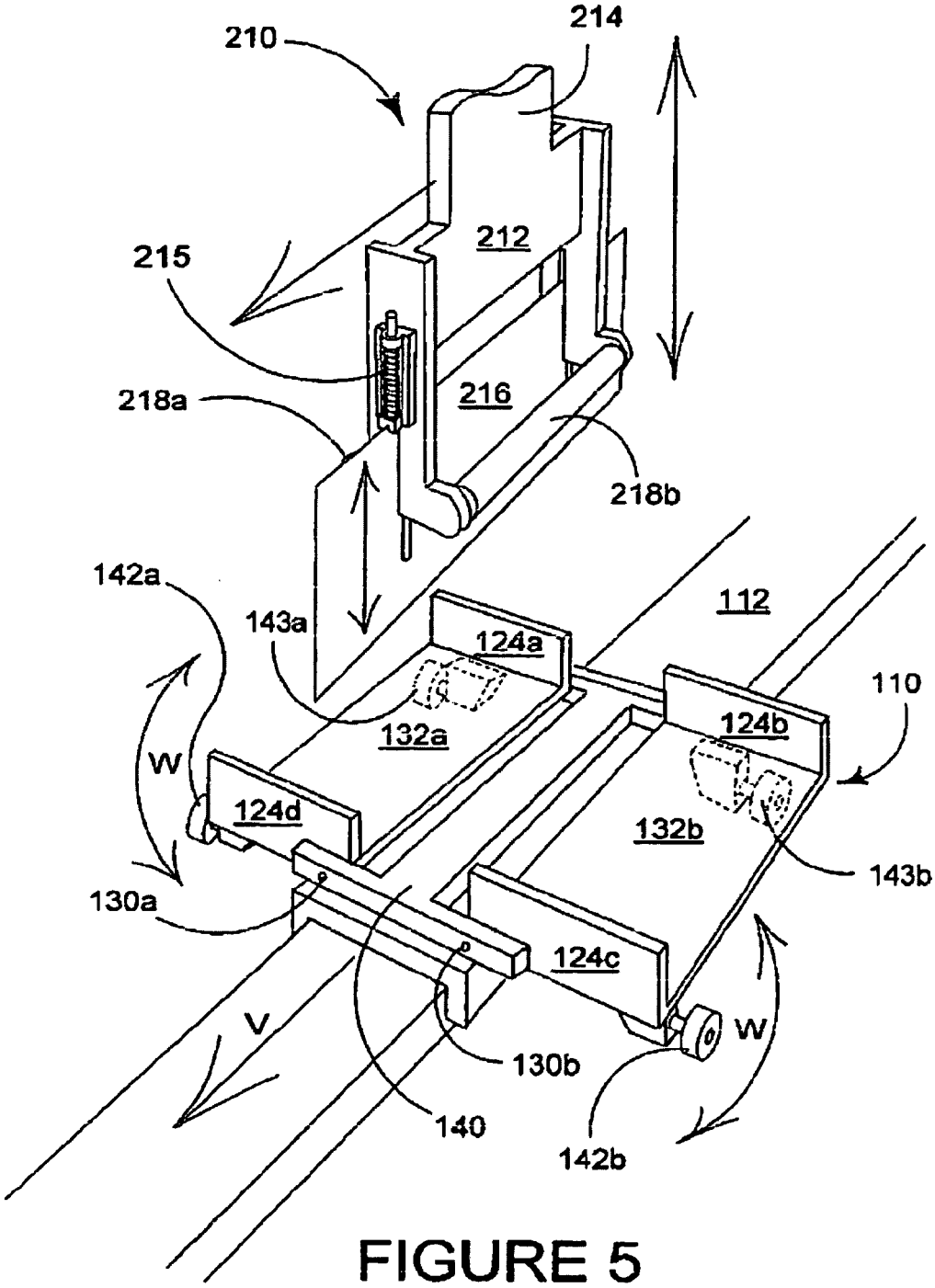
FIG. 5 is a schematic perspective view of apparatus used in the preferred embodiment of the packaging machine to construct the carton of FIG. 2.
Figure 6:
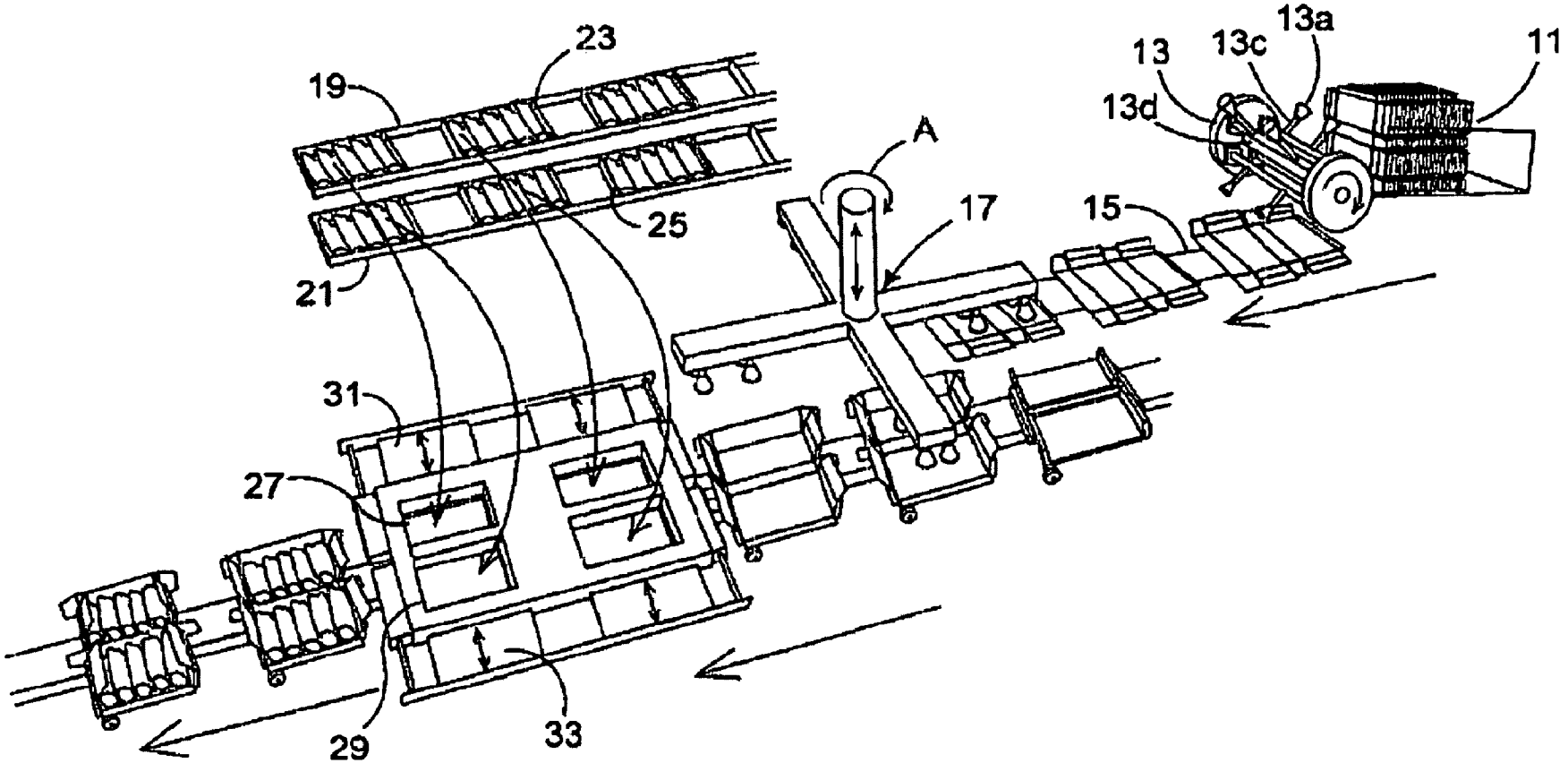
FIG. 6 is a schematic perspective view showing the overall arrangement of the packaging machine in which the apparatus of FIG. 5 assembles the carton of FIG. 2.

In the preferred embodiment, a separator or divider 210, to be herein described with reference to FIGS. 5 and 6, is placed at step A9 between the two sets of pouches. This separator 210 substantially prevents movement of the pouch sets towards one another and/or maintains them in a suitable configuration for the folding stage of the package's construction.

Figure 4:
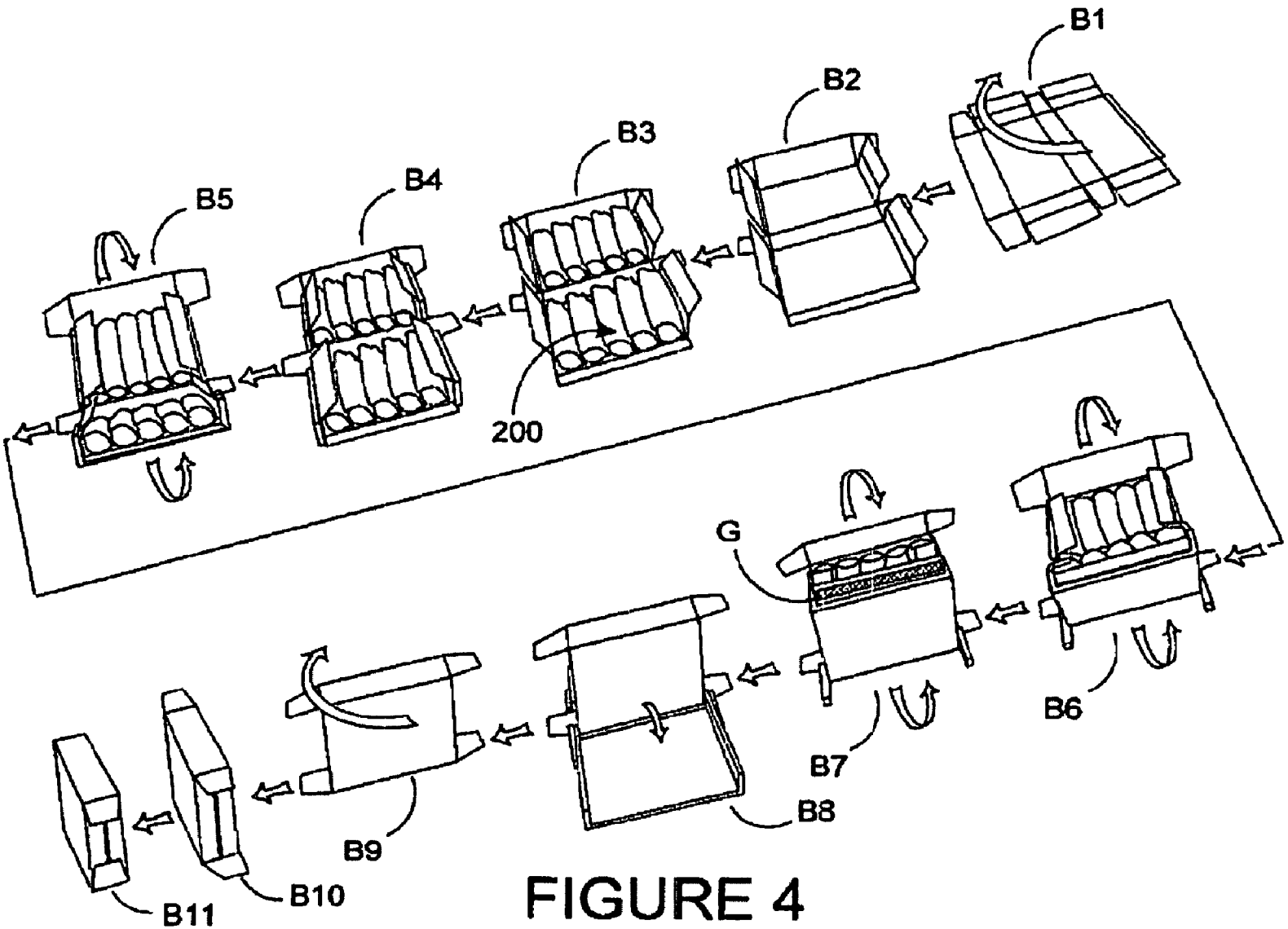
FIG. 4 is a schematic view showing a preferred sequence of folding, loading, forming and gluing operations for constructing the carton of FIG. 2.

The outer sections 132*a*, 132*b* of the forming jig 110, supporting spaced apart loading panels 14 and 18 are then simultaneously raised, step A10 of FIG. 3 and stage B5 and B6 of FIG. 4, rotationally, about hinged connections 130*a*, 130*b* to the centre portion 140, as indicated by arrows in stage B5 and B6 of FIG. 4. This has the effect of bringing together the two sets of pouches in juxtaposed relationship. Each of the spaced apart loading panels 14, 18 of the blank 10 are thereby simultaneously folded, step A10, out of the plane of the bottom panel 16 toward each other by the raising of the outer sections 132*a*, 132*b* of the jig. In this way pairs of reinforcing members, 26*a*/26*b* and 26*d*/26*c* are brought into flat face contacting relation with each other and the sets of pouches are brought from a position in which they rest on the spaced apart loading panels of the load panel 14, 18, to a position in which an end of each of the pouches rests upon the bottom panel 16.

The load exerted on the carton 30 from the sets of pouches is thus transferred from the spaced apart loading panels 14, 18 of the blank 10, when in the loading stage, step A7 of FIG. 3 and stage B3 of FIG. 4, to the previously unloaded bottom panel 16, during the folding stage. Bottom panel 16 of the blank 10 thereby becomes the bottom 16 of the package and the previously loaded loading panels 14, 18 become the side panels 14, 18.

The securing panel 20 is then folded inward of the carton and the top panel 12 is then folded to overlie the securing panel 20 and secured to it, step A11, using adhesive means to maintain assembly of the package, as shown in stage B7 of FIG. 4.

The previously raised outer sections 132*a*, 132*b* of the forming jig 110 are lowered, step A12, by rotationally moving them away from the side panels 14, 18 as shown by the arrow in stage B7 of FIG. 4 so that the carton then at stage B8 is ready for further processing.

The package is then rotated, step A13, about a vertical axis through approximately 90° as shown in stage B9 of FIG. 4 such that the end closure flaps 22*a*, 22*b*, 22*c*, 22*d* can be secured, step A14, in a further gluing stage. Referring to stage B9 of FIG. 4, it can be seen that the blank is rotated in a clockwise direction as shown by the arrow, but the rotation may be additionally combined with removal of the package from the forming jig 110. The skilled reader will appreciate that in alternative machine/carton configurations this rotation stage may not be required. The bottom and top end closure flaps 22*b*, 22*c*, 22*a*, 22*d* are folded and secured, step A14, to lower and upper portions of the end closure panels 24*a*/24*b*, 24*c*/24*d* respectively as shown in stages B10 and B11 of FIG. 4. In this way a completely enclosed carton is formed, which contains two sets of five pouches, the sets being partially separated by the reinforcing members 26*a*, 26*b*, 26*c*, 26*d*. FIG. 2 shows a schematic diagram of a carton 30 constructed from the blank 10, in an assembled package according to the present embodiment the carton 30 would contain ten pouches in two rows of five each with the reinforcing members between them.

Referring now to FIGS. 5 and 6 there is shown a forming jig 110 for controlling the formation of a package according to the present embodiment. The divider or separator 210 is also shown in FIGS. 5 and 6. The separator 210 provides a rigid temporary wall against which the sets of pouches can be brought into an upright attitude.

FIG. 5 shows the forming jig 110 onto which the blank 10 is placed and the separator 210. As indicated earlier, the blank 10 is placed such that spaced apart loading panels 14, 18 of the blank 10 lie on outer sections 132*a*, 132*b* of the forming jig 110 respectively and panel 16 is placed on section 140 of the forming jig 110. End walls 124*a*, 124*b*, 124*c*, 124*d* of the forming jig 110 are positioned such that they facilitate folding of end panels 24*a*, 24*b*, 24*c*, 24*d* out of the plane of the panels 14, 16, 18. The height of the walls 124*a*, 124*b*, 124*c*, 124*d* should not prevent the panels 14 and 18 being raised to be substantially 90° to the panel 16; or in alternative embodiments, otherwise prevent construction of the package. End flaps 22*b* and 22*c* protrude through the space between walls 124*a*, 124*b* and 124*a*, 124*c*, respectively.

Sections 132*a* and 132*b* are coupled together by section 140 of the forming jig 110 by hinged connections 130*a* and 130*b*. Section 140 follows a guide track 112. The guide track substantially prevents section 140 and hence the hinged connections 130*a* 130*b* from moving in a direction perpendicular to the direction of travel the forming jig 110. A conveyor means, not shown, propels the forming jig 110 along the guide track in desired direction of travel as indicated by the arrow "V" in FIG. 5.

Figure 7:
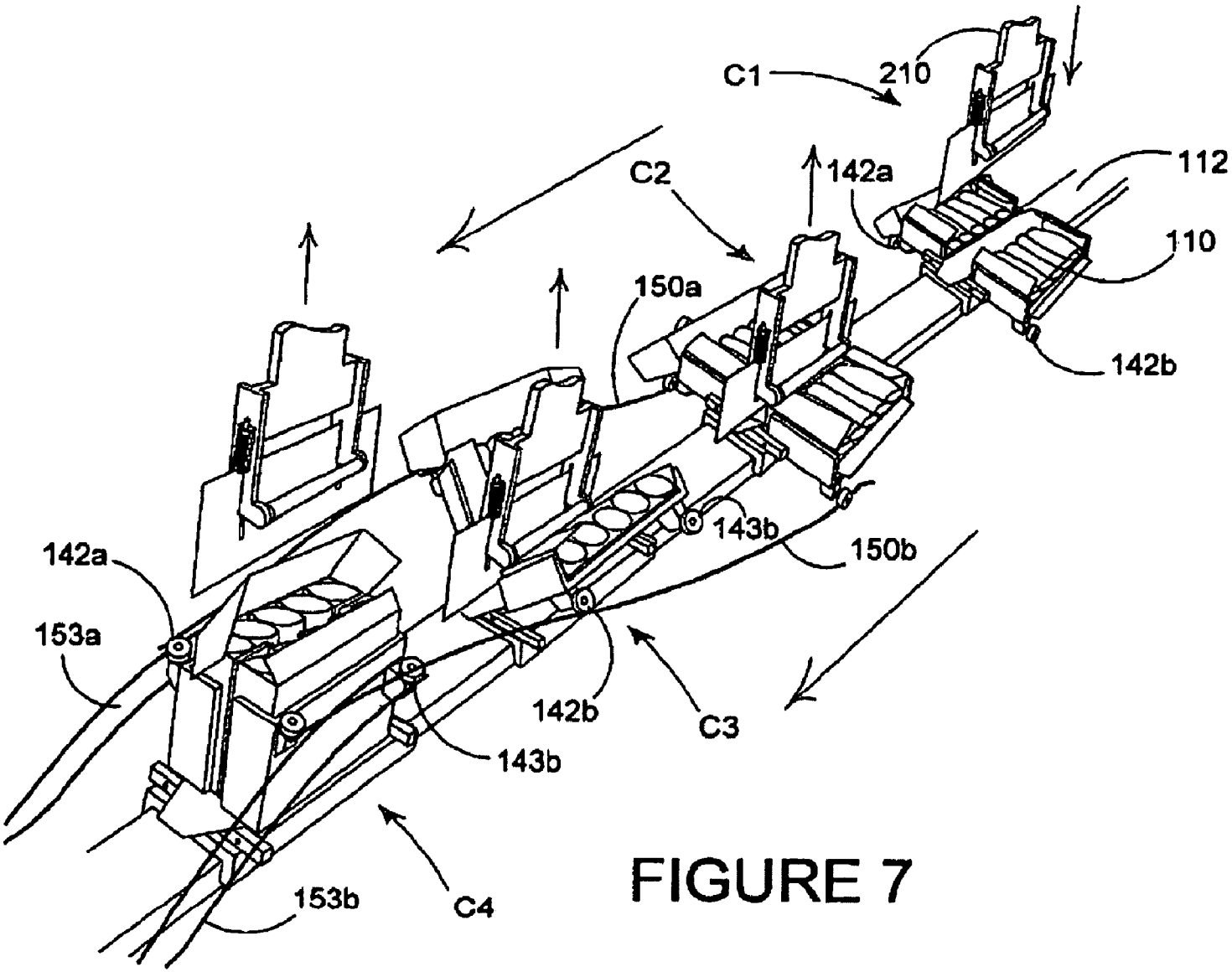
FIG. 7 is a schematic perspective view showing the operation of a jig mechanism which forms successive loaded blanks into complete cartons.

Wheels 142*a*, 142*b* which are shown at the forward end of jig 110 in FIGS. 5, 6 and 7 facilitate the rotation of sections 132*a*, 132*b* about hinged connections 130*a*, 130*b* in any upward direction thereby achieving the folding of panels 14, 18 about fold lines 34, 36. The rotation as indicated by arrows "W" in FIG. 5 is achieved by causing each wheel 142*a*, 142*b* to engage a rail or runner, 150*a* and 150*b*, best shown in FIG. 7, which, by virtue of its overall shape, causes the wheels 142*a* 142*b* to be raised upwardly out of the horizontal plane of the guide track 112 and simultaneously inwardly towards the guide track 112. It will be appreciated by those skilled in the art that this process could be achieved by alternative means.

The separator 210 of FIG. 5 comprises a main frame 212 a portion 214 of which is coupled to an overhead conveyor means (not shown). A dividing plate 216 which restricts movement of the sets of pouches during the package's assembly is resiliently mounted in the frame 212 by resilient means, for example, spring assembly 215. The separator 210 of FIG. 5 runs above the forming jig 110, on the overhead conveyor means, as the forming jig 110 passes through the section of the packaging machine where the folding of the blank 10 occurs. This is best illustrated in FIG. 7.

Two rollers 218*a*, 218*b* one on each of the opposed sides of the main body 212 are positioned such that they maintain correct alignment of the reinforcing panels 26*a*, 26*b*, 26*c*, 26*d* during the package's construction. In alternative embodiments, these rollers could have an additional function such as the application of an adhesive to the reinforcing members 26*a*, 26*b*, 26*c*, 26*d*.

Referring again to FIG. 7, sections 132*a* and 132*b* of the forming jig 110 are rotated towards each other, by following the track 150*a*, 150*b*. The separator 210 is raised upwardly out of the package, maintaining correct alignment of the reinforcing members 26*a*, 26*b*, 26*c*, 26*d* as it rises (stage C3 of FIG. 6). Referring, in particular, to FIG. 6, the jig 110 enters the carton assembly stage of the packaging machine as indicated by stage C2, in which the pouches are loaded onto loading panels 14 and 18 of the blank 10 and the reinforcing members 26*a*, 26*b*, 26*c*, 26*d* have been folded inward of the blank 10. The separator 210 is brought into alignment above the jig 110. By stage. C2 of this section of the packaging machine, the separator 210 has been placed between the two groups of pouches. The wheels 142*a*, 142*b* are engaged with the beginning of the track 150*a*, 150*b*. The entry end of the track 150*a*, 150*b* is positioned to capture the wheels 142*a*, 142*b* within the tracks 150*a*, 150*b* as it approaches. This minimizes the risk of the wheel missing the track 150*a*, 150*b* and/or becoming jammed against the track 150*a*, 150*b*. As the jig 110 moves along the guide track 112 the wheels 142*a*, 142*b* follow the track 150*a*, 150*b* thus moving the outer sections 132*a*, 132*b* of the jig 110, and hence the spaced apart loading panels 14, 18 toward each other. The wheels follow the track 150*a*, 150*b* until at their highest evaluation (stage C4 of FIG. 7) from the horizontal of the tracks upward and inward deviation from its start position. In stage C4 of FIG. 7, the carton 30 is in a substantially assembled state. Whilst the jig 110 is moving forward along the guide track 112 and the wheels 142*a*, 142*b* are following the track 150*a* 150*b* to raise the outer sections 132*a*, 132*b* of the jig 110, the separator 210 is moved upward away from the bottom panel 16 of the blank 10. As the separator 210 moves upwardly the rollers 218*a*, 218*b* on either side of dividing section 216 maintain the correct alignment of the reinforcing members 26*a*, 26*b*, 26*c*, 26*d* relative to the pouches. However, by virtue of its resilient mounting, upward movement of the dividing plate 216 lags behind that of the main frame 212 and this lost motion allows a dwell time of the plate 216 between the pouch sets until they will inevitably be brought into juxtaposition as sections 132*a* and 132*b* approach one another.

The top panel 12 is then adhered to the securing panel 20 to maintain the carton in an assembled state and then the wheels 142*a*, 142*b* follow the track 150*a*, 150*b* downwardly and outwardly in a mirror image of the section of track 150*a*, 150*b* shown. Thus the outer sections 132*a*, 132*b* of the jig 110 are disengaged from the side panel 14, 18 of the carton 30.

However, at position C4 rear wheels 143*a*, 143*b* of the forming jig, carried by sections 132*a*, 132*b*, respectively engage double rail sets 153*a*, 153*b* respectively which are shaped to draw down the sections 132*a*, 132*b* into their horizontal loading positions as the forming jig 110 continues its forward motion.

It is envisaged that the blank 10 can vary depending upon the shape and/or quantity of articles to be packaged and accordingly, a machine in accordance with one or more aspects of the present invention is adjustable in numerous respects so that it can process a wide variety of such blanks and is not limited to the specific example outlined above. Indeed a machine of the present invention may be used to package items other than beverage pouches within a paperboard carton. For example, it is envisaged that any other similar article could be processed using a machine of the present invention.

It will be recognized that as used herein, directional references such as "top", "bottom", "end" and "side" do not limit the respective panels to such orientation, but merely serve to distinguish these panels from one another. Any reference to hinged connection should not be construed as necessarily referring to a single fold line only: indeed it is envisaged that hinged connection can be formed from one or more of the following: a score line, a frangible line or a fold line, without departing from the scope of the present invention.

It is envisaged that one skilled in the art could make minor changes to the present invention without departing from the scope of the invention, for example alternative configurations of the group of articles could be used, alternative means to facilitate the folding of the blank around the pouches could be used which would fulfill the alignment and construction properties of preferred embodiment herein described. It will be appreciated by those skilled in the art that the present invention is not limited to cartons of the type described but could be applied to other carton types. It is therefore envisaged that the method employed by the present invention may also be adjustable in order to accommodate a variety of carton arrangements.

What is claimed is:

1. A method of forming a carton containing a group of articles, which method comprises placing first and second sets of the articles onto spaced apart loading panels of a carton blank so that the article sets are spaced apart with an unloaded further panel of the blank disposed between the article sets, raising the spaced loading panels together with the respective sets of articles to transfer the sets of articles to the unloaded further panel so that said unloaded further panel becomes a loaded base of the carton and those spaced apart areas of the loading panel become opposed side panels of the carton;

wherein the carton blank in substantially flat form is transferred from a supply to a forming jig so that spaced apart loading panels of the blank are placed on spaced outer sections of the jig with the further panels of the blank disposed there between on an inner section of the jig and so that opposed end closure panels of the blank automatically are folded out of the plane of respective loading panels and loading a set of articles onto each of said loading panels;

wherein reinforcing panels, hinged to the end closure panels are folded relative to the end closure panels so that a reinforcing panel is caused to overlie the endmost articles in each set such that each endmost article is substantially surrounded by a loading panel, an end closure panel and a reinforcing panel;

wherein a separator device is positioned between each article set substantially to prevent movement of the article sets, on their respective loading panels towards one another; and wherein the spaced outer sections of the jig are raised so that the loading panels with their respective articles sets are raised, and retracting the separator device as the article sets are brought together and the loading panels are brought into an upright attitude whereby the article sets are brought together with the ends of the articles in each set brought to rest on said further panel of the blank, destined to become a base panel of the carton, with the loading panels providing opposed side panels of the carton.

2. A method according to claim 1 wherein juxtaposed reinforcing panels are brought into face to face relationship to provide a multiply partition between the endmost articles of each article set.

3. A method according to claim 1 wherein the carton panels are secured to complete the carton around the article sets and the spaced outer sections of the jig are returned to their original positions to receive respective loading panels of the next succeeding carton blank.

4. A method according to claim 1 wherein successive article sets are formed on article conveying means which is synchronized with conveying means for inclusive blank and jig units and the requisite article sets and drop-loaded onto pre-determined ones of the loading panels of each blank.

5. An apparatus for forming a carton containing a group of articles which apparatus comprises a supporting means on which a carton blank, together with first and second sets of articles is received, the articles being disposed on spaced apart areas of a loading panel of the blank so that the article sets are spaced apart with an unloaded portion of the loading panel disposed between the article sets, conveyor means for conveying said supporting means and blank thereon through the apparatus, and means for manipulating the supporting means during conveying by said conveyor means to raise the spaced apart areas of the loading panel together with the respective sets of articles to transfer the sets of articles to the unloaded portion of the loading panel so that it receives both sets of articles and so that said unloaded portion of the loading panel becomes a loaded base of the carton and those spaced apart areas of the loading panel become opposed side panels of the carton.

6. An apparatus according to claim 5 wherein the supporting means comprises a forming jig and wherein carton blank transfer means is provided for transferring successive carton blanks from a supply and placing each blank on said jig and means for grouping and depositing discrete groups of articles onto said blank while it is disposed on said jig.

7. An apparatus according to claim 6 wherein the means for raising the spaced apart areas of the loading panel comprises hinged sections of said jig.

8. An apparatus according to claim 7 wherein the means for manipulating the supporting means includes a follower device, which follows a predetermined path in a track or runner which facilitates the raising of the hinged sections and thereafter lowering of the hinged sections for reloading.

9. An apparatus according to claim 5 further comprising means for limiting movement of the article sets towards one another relative to the loading panels during carton assembly.

10. An apparatus according to claim 9 wherein the means for limiting movement of the article set towards one another relative to the loading panel during carton assembly.

11. A method for forming a carton containing a group of articles, which method comprises placing a carton blank on a forming jig, placing first and second sets of the articles onto spaced apart loading panels of the blank so that the article sets are spaced apart with an unloaded further panel of the blank disposed between the article sets, conveying the forming jig along a conveyor means and simultaneously causing outer sections of the forming jig to be brought together thereby raising the spaced loading panels together with the respective sets of articles to transfer the sets of articles to the unloaded further panel so that said unloaded further panel becomes a loaded base of the carton and those spaced apart areas of the loading panel become opposed side panels of the carton.

12. A method according to claim 11 wherein the carton blank in substantially flat form is transferred from a supply to said forming jig, and wherein opposed end closure panels of the blank automatically are folded out of the plane of respective loading panels.

13. A method according to claim 12 wherein successive article sets are formed on article conveying means which is synchronised with conveying means for inclusive blank and jig units and the requisite article sets and drop-loaded onto pre-determined ones of the loading panels of each blank.

14. A method according to claim 12 wherein reinforcing panels, hinged to the end closure panels are folded relative to the end closure panels so that a reinforcing panel is caused to overlie the endmost articles in each set such that each endmost article is substantially surrounded by a loading panel, an end closure panel and a reinforcing panel.

15. A method according to claim 14 wherein juxtaposed reinforcing panels are brought together into face to face relationship to provie a multiply partition between the endmost articles of each article set.

16. A method according to claim 14 wherein a seperator device is positioned between each article set substantially to prevent movement of the article sets, on their respective loading panels towards one another.

17. A method according to claim 16 wherein the spaced outer sections of the jig are raised so that the loading panels with their respective articles sets are raised, and retracting the separator device as the article sets are brought together and the loading panels are brought into an upright attitude whereby the article sets are brought together with the ends of the articles in each set brought to rest on said further panel of the blank, destined to become a base panel of the carton, with the loading panels providing opposed side panels of the carton.

18. A method according to claim 17 wherein the carton panels are secured to complete the carton around the consolidated article sets and the spaced outer sections of the jig are returned to their original positions to receive respective loading panels of the next succeding carton blank.

* * * * *